US006075965A

United States Patent [19]

Tombs et al.

[11] Patent Number: 6,075,965

[45] Date of Patent: Jun. 13, 2000

[54] METHOD AND APPARATUS USING AN ENDLESS WEB FOR FACILITATING TRANSFER OF A MARKING PARTICLE IMAGE FROM AN INTERMEDIATE IMAGE TRANSFER MEMBER TO A RECEIVER MEMBER

[75] Inventors: Thomas N Tombs, Brockport; Bruce R. Benwood, Churchville, both of N.Y.

[73] Assignee: Eastman Kodak Company, Rochester, N.Y.

[21] Appl. No.: 08/900,696

[22] Filed: Jul. 25, 1997

Related U.S. Application Data

[63] Continuation-in-part of application No. 08/681,746, Jul. 29, 1996, abandoned.

[51] Int. Cl.[7] ..... G03G 15/16

[52] U.S. Cl. ..... 399/308; 399/302; 399/313

[58] Field of Search ..... 399/297, 298, 399/299, 300, 301, 302, 303, 308, 310, 311, 312, 313, 314

[56] References Cited

U.S. PATENT DOCUMENTS

| | | | |
|---|---|---|---|
| 3,781,105 | 12/1973 | Meagher . | |
| 4,114,536 | 9/1978 | Kaneko et al. . | |
| 4,163,549 | 8/1979 | Ito et al. . | |
| 4,439,462 | 3/1984 | Tarumi et al. . | |
| 4,712,906 | 12/1987 | Bothner et al. . | |
| 4,910,558 | 3/1990 | Giezeman et al. . | |
| 4,931,839 | 6/1990 | Tompkins et al. . | |
| 5,040,028 | 8/1991 | Kamimura et al. . | |
| 5,053,827 | 10/1991 | Tompkins et al. . | |
| 5,075,731 | 12/1991 | Kamimura et al. . | |
| 5,084,735 | 1/1992 | Rimai et al. . | |
| 5,132,743 | 7/1992 | Bujese et al. . | |
| 5,138,389 | 8/1992 | Randall | 399/302 |
| 5,159,393 | 10/1992 | Hiroshima et al. | 399/313 |
| 5,187,526 | 2/1993 | Zaretsky . | |

(List continued on next page.)

FOREIGN PATENT DOCUMENTS

| | | |
|---|---|---|
| 4058895 | 12/1995 | Australia . |
| 0 505 168 A2 | 9/1992 | European Pat. Off. . |
| 0 712 052 A2 | 5/1996 | European Pat. Off. . |
| 0 718 718 A1 | 6/1996 | European Pat. Off. . |
| 0 735 938 A1 | 10/1996 | European Pat. Off. . |
| 2 344 875 | 3/1977 | France . |
| 53-25440 | 9/1978 | Japan . |
| 55-100568 | 7/1980 | Japan . |
| 63-193168 | 8/1988 | Japan . |
| 8-114997 | 5/1996 | Japan . |
| WO 91/13386 | 9/1991 | WIPO . |

OTHER PUBLICATIONS

Patent Abstracts of Japan, Publication No. 09106201, Apr. 22, 1997, Katsuragawa Electric Company, Ltd, Inventor: Yoshino Masakazu.

*Primary Examiner*—Sandra Brase
*Attorney, Agent, or Firm*—Norman Rushefsky

[57] ABSTRACT

A reproduction method and apparatus including a primary image forming member, and a substantially cylindrical intermediate image transfer member operatively associated with the primary image forming member whereby a marking particle image formed on the primary image forming member can be electrostatically transferred from the primary image forming member to the intermediate image transfer member (ITM). An endless web arrangement is provided in cooperative association with the ITM. The endless web arrangement includes an endless web and a plurality of support rollers about which the endless web is entrained. A transfer nip for transfer of an image to receiver member is defined between the ITM and the endless web. An electrical transfer field is provided for electrostatically transferring a marking particle image to a receiver member brought into intimate contact with the ITM in the nip.

Wrap of the endless web about the ITM is preferably greater than the nip length or area to ensure intimate contact of the receiver member in the nip and reduce pre-nip transfer and pre-nip ionization.

49 Claims, 8 Drawing Sheets

U.S. PATENT DOCUMENTS

| | | | |
|---|---|---|---|
| 5,198,863 | 3/1993 | Goto et al. | 399/314 |
| 5,233,396 | 8/1993 | Simms et al. . | |
| 5,270,769 | 12/1993 | Satoh et al. . | |
| 5,278,613 | 1/1994 | Bisaiji et al. . | |
| 5,370,961 | 12/1994 | Zaretsky et al. . | |
| 5,408,302 | 4/1995 | Manzer et al. . | |
| 5,438,398 | 8/1995 | Tanigawa et al. | 399/302 |
| 5,450,180 | 9/1995 | Ohzeki et al. | 399/314 X |
| 5,499,086 | 3/1996 | Matsuno et al. . | |
| 5,581,327 | 12/1996 | Izumizaki et al. | 399/299 X |
| 5,602,633 | 2/1997 | Yoshida et al. | 399/311 X |
| 5,710,964 | 1/1998 | Tombs et al. . | |
| 5,732,312 | 3/1998 | Takekoshi et al. | 399/299 X |
| 5,752,130 | 5/1998 | Tanaka et al. | 399/308 X |
| 5,774,771 | 6/1998 | Kukimoto et al. | 399/302 X |

METHOD AND APPARATUS USING AN ENDLESS WEB FOR FACILITATING TRANSFER OF A MARKING PARTICLE IMAGE FROM AN INTERMEDIATE IMAGE TRANSFER MEMBER TO A RECEIVER MEMBER

This application is a continuation-in-part of U.S. application Ser. No. 08/681,746, filed Jul. 29, 1996. This application is also related to U.S. application Ser. No. 08/681,637, filed Jul. 29, 1996 and now U.S. Pat. No. 5,710,964.

BACKGROUND OF THE INVENTION

The present invention relates in general to reproduction apparatus including an intermediate image transfer member wherein a marking particle image is transferred from a primary image forming member to the intermediate image transfer member and then to a receiver member, and more particularly to an endless web mechanism for facilitating transfer of a marking particle image from the intermediate transfer member to the receiver member which may be a paper or plastic sheet upon which the image is to be fixed.

In modern high speed/high quality electrostatographic reproduction apparatus (copier/duplicators or printers), a latent image charge pattern is formed on a uniformly charged dielectric support member. Pigmented marking particles are attracted to the latent image charge pattern to develop such image on the support. The dielectric support is then brought into contact with a receiver member and an electric field applied to transfer the marking particle developed image to the receiver member from the dielectric support. After transfer, the receiver member bearing the transferred image is transported away from the dielectric support and the image is fixed to the receiver member by heat and/or pressure to form a permanent reproduction thereon.

Application of the electric field to effect marking particle transfer is generally accomplished by ion emission from a corona charger onto the receiver member while in contact with the dielectric support, or by an electrically biased roller urging the receiver member against the dielectric support. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric support is remarkably efficient in providing intimate uniform contact therebetween. Moreover, in color systems, a receiver sheet can be attached to a roller and the roller rotated to bring the sheet through transfer relationship with a primary image member. An electric field between the drum and the image member superposes a series of single color images on the sheet creating a multicolor image. See, for example, U.S. Pat. No. 4,712,906, Bothner et al, issued Dec. 15, 1987 which is representative of a large number of references in commercial apparatus using this approach.

U.S. Pat. No. 3,781,105 granted to Meagher Dec. 25, 1973 suggests a backing roller for transferring single color images to a receiver sheet. In this instance the reference suggests that the backing roller have an outside layer or layers of a low intermediate conductivity and that a constant current source be used for establishing an electric field. The intermediate conductivity is established by using material having a resistivity of $10^9$ to $10^{11}$ohm-cm. This material is conductive enough to permit the establishment of an electric field but provides a relatively high impedance which causes the field to be less variable in response to variations in the receiver sheet. With such more resistant materials, receiver sheets can vary between paper and transparency stock and also as to thickness and ambient relative humidity without an unacceptable variation in the field that would cause insufficient transfer in some instances or electrical breakdown in others.

Backing rollers having a resistivity in the neighborhood of $10^{10}$ohm-cm are commonly made by doping a high resistance polyurethane material with tiny conductive particles such as carbon, iron or other antistatic materials sufficiently to provide the conductivity needed. Although such backing rollers having a high resistivity are considered preferred in such systems, they do generate problems. If the field is provided between two members that roll in contact with each other, the field is constantly being established through that rolling contact. The substantial resistance of the backing roller increases the time constant in establishing the field thereby either increasing the necessary size of the nip for transfer or reducing the speed of the system.

A number of references show the use of intermediates in both single color image formation and multicolor image formation. For example, FIG. 8 of the above mentioned U.S. Pat. No. 4,712,906 shows a series of single color images being formed on a primary image member. The single color images are transferred in registration to an intermediate roller to create a multicolor image on the surface of the roller. A multicolor image is then transferred in a single step to a receiver sheet at a position remote from the primary image member. This system is particularly advantageous in forming multicolor marking particles images, because the receiver sheet does not have to be attached to a roller for recirculation but can be fed along a substantially straight path. It can also be used with single color marking particles image formation for a number of other reasons including facilitating duplex and preventing contact between a primary image member and a receiver sheet which may contaminate the image member with paper fibers and the like.

U.S. Pat. No. 4,931,839 granted to Tompkins et al on Jun. 5, 1990 shows use of an intermediate web of relatively high intermediate conductivity which superposes single color marking particles images by transfer from a primary image member. The images are transferred to a receiver sheet which is backed by a conductive roller. Substantial impedance does not appear to be provided at this transfer to allow for variations in receiver sheet impedance.

In U.S. Pat. No. 5,187,526 granted to Zaretsky on Feb. 16, 1993, there is shown a transfer arrangement with the advantages that are obtained from use of an intermediate, while still handling a variety of receiver sheets and operating at reasonable speed. In this arrangement, an electrostatic image is formed on a primary image member. Marking particles are applied to the electrostatic image to create a marking particles image corresponding to the electrostatic image. The marking particles image is carried by the primary image member into transfer relation with an intermediate image member having a resistivity less than $10^9$ohm-cm while applying an electric field between the image members sufficient to transfer the marking particles image to the intermediate image member. The marking particles image is then brought into transfer relation with a receiver sheet while the receiver sheet is backed by a transfer backing member having a resistivity of $10^{10}$ohm-cm or greater in the presence of an electric field between the intermediate image member and the transfer backing member urging transfer of the marking particles image to the receiver sheet. The relatively high conductivity of the intermediate image member facilitates efficient transfer of marking particles images from the primary image member to the intermediate image member using a fairly narrow nip. A high resistance intermediate image member is not necessary at this transfer because no receiver sheet is present. At the second transfer in which the receiver sheet is present, impedance is provided by the transfer backing member rather than the intermediate image member and the nip is somewhat longer allowing for the slower rise time of the electric field.

This arrangement is particularly usable in color processes in which the color image is created on the intermediate image member by superposition of a series of single color images formed on the primary image member. Superposition of the single color marking particles images on the intermediate image member is facilitated by a more conductive intermediate image member. The second transfer to the receiver sheet is facilitated by the less conductive transfer backing member in that transfer.

Difficulties in using an intermediate image member are related to controlling the transfer field in the nip area between the intermediate member and the transfer backing member and in achieving reliable detack of a receiver member from the intermediate image member. Marking particle image transfer has heretofore been compromised to ensure transfer field control and detack because marking particle transfer and detack are accomplished with the same roller. The coupling of marking particle transfer and detack is complicated and imparts significant constraints on the design of the intermediate image member, increases the overall cost of the transfer system, and degrades image quality. Moreover, further problems with the intermediate image member are encountered when receiver members become exposed to a wide range of relative humidities, and also when many different receiver member types and weights are used (especially receiver members with low stiffness such as light weight papers).

SUMMARY OF THE INVENTION

This invention is directed to a reproduction apparatus and method including a primary image forming member, and an intermediate image transfer member operatively associated with the primary image forming member whereby a marking particle image formed on the primary image forming member can be electrostatically transferred from the primary image forming member to the intermediate image transfer member. An endless web arrangement is provided to define a transfer nip with the intermediate image transfer member. An electric transfer field is established in the nip for electrostatically transferring a marking particle image to a receiver member brought into intimate contact with the intermediate image transfer member in the nip.

BRIEF DESCRIPTION OF THE DRAWINGS

In the detailed description of the preferred embodiments of the invention presented below, reference is made to the accompanying drawings, in each of which the relative relationship of the various components are illustrated, it being understood that orientation of the apparatus may be modified.

DETAILED DESCRIPTION OF THE PREFERRED EMBODIMENTS

Figure 1:
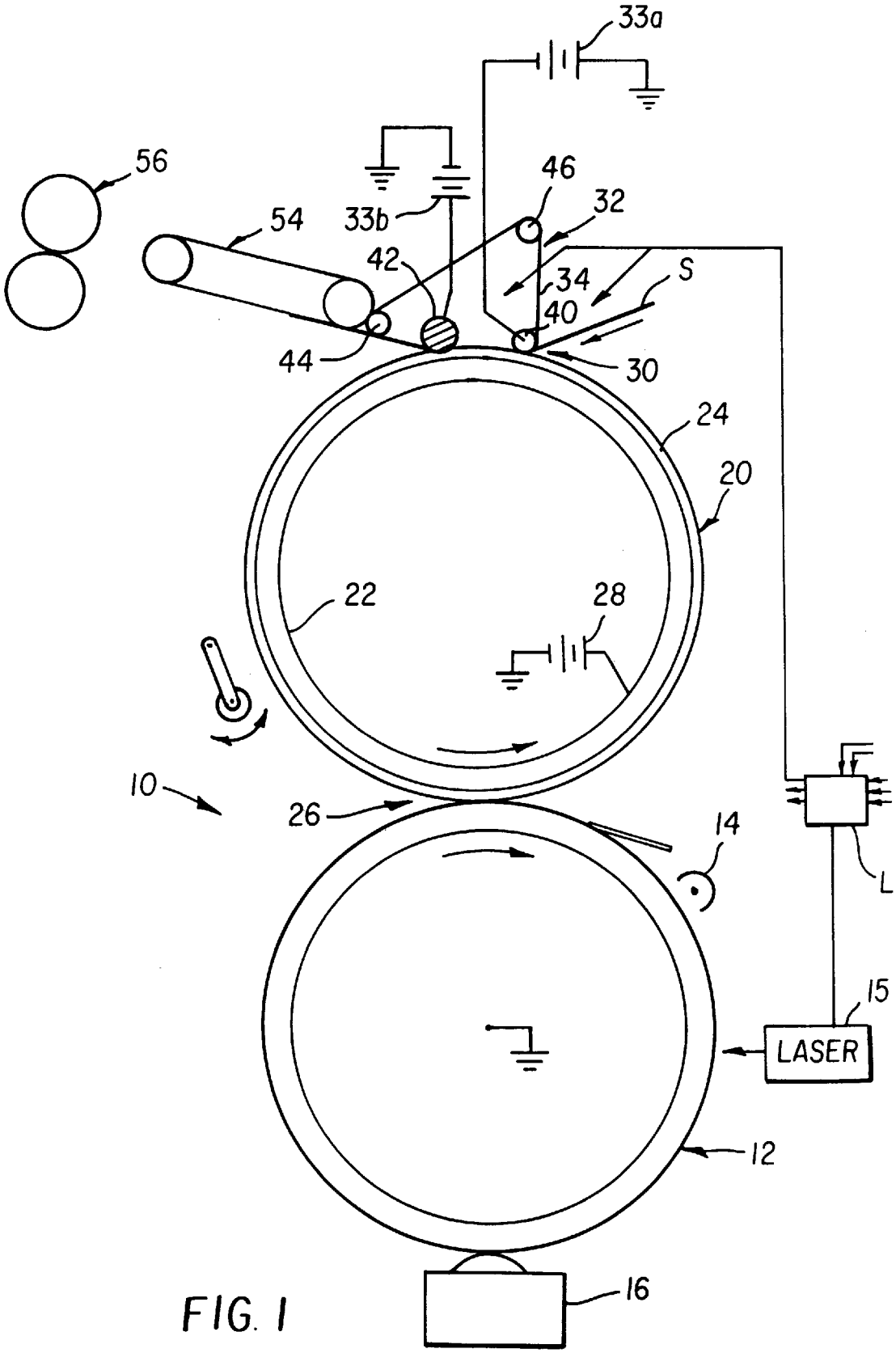
FIG. 1 is a generally schematic side elevational view of a first embodiment of a reproduction apparatus utilizing an intermediate image transfer member with an endless web mechanism for facilitating transfer of a marking particle image from the intermediate image transfer member to a receiver member according to this invention, only basic components being shown for clarity of illustration.

Referring now to the accompanying drawings, FIG. 1 shows an exemplary image forming reproduction apparatus designated generally by the numeral 10. The reproduction apparatus 10 includes a primary image forming member, for example a drum 12. The drum 12 has a photoconductive surface, upon which a pigmented marking particle image, or a series of different color marking particle images, is formed. In order to form images, the outer surface of drum 12 is uniformly charged by a primary charger such as a corona charging device 14 or other suitable charger such as roller chargers, brush chargers, etc. The uniformly charged surface is exposed by suitable exposure means, such as for example a laser 15 or LED or other electro-optical exposure device or even an optical exposure device to selectively alter the charge on the surface of the drum 12 to create an electrostatic image corresponding to an image to be reproduced. The electrostatic image is developed by a application of pigmented marking particles to the image bearing photoconductive drum 12 by a development station 16. The development station 16 may include from one to four (or more) separate developing devices. When more than one developing device is provided, each device has particular different color marking particles associated respectively therewith. Each device is separately indexed into operative developing relation with drum 12 to apply different color marking particles respectively to a series of images formed by the exposure device carried on drum 12 to create a series of different color marking particle images.

The marking particle image is transferred (or multiple marking particle images are transferred one after another in registration) to the outer surface of a secondary or intermediate image transfer member, for example, an intermediate transfer drum 20. The intermediate transfer drum 20 includes a metallic conductive core 22 and a compliant layer 24. The compliant layer 24 is formed of an elastomer such as polyurethane or other materials noted in the references cited herein, which has been doped with sufficient conductive material (such as antistatic particles, ionic conducting materials, or electrically conducting dopents) to have a relatively low resistivity (for example, a bulk or volume electrical resistivity preferably in the range of approximately $10^7$ to $10^{10}$ohm-cm). Further, the compliant layer is more than 1 mm thick, preferably between 2 mm and 15 mm, and has a Young's Modulus in the range of approximately 0.1

MPa to 10 MPa, and more preferably between 1 MPa and 5 MPa. With such a relatively conductive intermediate image transfer member drum 20, transfer of the single color marking particle images to the surface of drum 20 can be accomplished with a relatively narrow nip 26 and a relatively modest potential of, for example, 600 volts applied by potential source 28.

A single marking particle image, or a multicolor image comprising multiple marking particle images respectively formed on the surface of the intermediate image transfer member drum 20, is transferred in a single step to a receiver member S, which is fed into a nip 30 between intermediate image transfer member drum 20 and a transfer backing member according to this invention, designated generally by the numeral 32. The receiver member S is fed from a suitable receiver member supply (not shown) into nip 30 where it receives the marking particle image. The receiver member exits the nip 30 and is transported by transport mechanism 54 to a fuser 56 where the marking particle image is fixed to the receiver member by application of heat and/or pressure. The receiver member with the fixed marking particle image is then transported to a remote location for operator retrieval.

Appropriate sensors (not shown) of any well known type, such as mechanical, electrical, or optical sensors for example, are utilized in the reproduction apparatus 10 to provide control signals for the apparatus. Such sensors are located along the receiver member travel path between the receiver member supply through the nip 30 to the fuser 56. Further sensors are associated with the primary image forming member photoconductive drum 12, the intermediate image transfer member drum 20, the transfer backing member 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

As noted above, particular difficulties with the use of the intermediate image transfer member are related to controlling the transfer field in the nip area between the intermediate member and the transfer backing member and in achieving reliable detack of a receiver member from the intermediate image transfer member. Further contributing to the difficulties is the fact that the receiver members utilized with the reproduction apparatus 10 can vary substantially. For example, they can be thin or thick paper stock or transparency stock. As the thickness and/or resistivity of the receiver member stock varies, the resulting change in impedance affects the electric field used in the nip 30 to urge transfer of the marking particles. Moreover, variations in relative humidity will vary the conductivity of a paper receiver member, which also causes it to affect the impedance of the transfer field. Therefore, to overcome these problems, the transfer backing member 32 according to this invention is an endless web arrangement.

The endless web arrangement of the transfer backing member 32 includes an endless web 34 entrained about a plurality of support members. For example, as shown in FIG. 1, the plurality of support members are rollers 40, 42, 44, and 46 (of course, other support members such as skis or bars would be suitable for use with this invention). The endless web 34 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web have a bulk resistivity of greater than $10^{12}$ ohm-cm. The web material may be of any of a variety of flexible materials such as a fluorinated copolymer, polycarbonate, polyurethane or silicone rubber. Whichever material that is used, such web material may contain an additive, such as an anti-stat (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. While it is envisioned that this invention could be used with an additional conducting layer beneath the resistive layer which is electrically biased to urge marking particle image transfer, it is more preferable to have an arrangement without the conducting layer and instead apply the transfer bias through either one or more of the support rollers or with a corona charger in the manner described below.

As shown, the endless web 34 is entrained about, and runs between several support rollers (preferably four or more). Several of the support rollers (rollers 40 and 42 in the Figures) are located such that the web exhibits a wrap angle about a portion of the intermediate image transfer member drum 20 so as to establish the nip 30. As noted above, the nip 30 defines the area for the transfer of marking particle images from the intermediate image transfer member drum 20 to a receiver member (e.g. paper, transparency, etc.) which is transported at the appropriate time, under the control of the logic and control unit L, between the web 34 and intermediate image transfer member. The support roller 42 at the exit from the nip 30 is relatively hard (i.e., has a high young's Modulus substantially greater than 10 MPa), and is of a small diameter when compared to the intermediate image transfer member drum 20. Further, the support roller 42 is located so as to provide substantial pressure engagement with the intermediate image transfer member drum 20 to ensure detack of the receiver member from the intermediate image transfer member by compressing the compliant outer surface layer 24 of the intermediate image transfer member and pinching the receiver member off the layer. The geometry of the endless web 34 at the nip exit is preferably arranged to electrostatically attract the receiver member to the web 34, in that portion of the web between the support rollers 42 and 44, so that the receiver member is transported away from the nip area by the web 34 to the transport 54. The receiver member can then subsequently be detacked from the web 34 at another support roller (e.g., roller 44).

In the embodiment of the reproduction apparatus 10 shown in FIG. 1, according to this invention, one or more marking particle images are transferred to the receiver member S in nip 30, between the endless web 34 and the intermediate image transfer member drum 20, established by support rollers 40 and 42 which support the endless web. Support roller 42 is electrically biased by potential source **33*b* to a level (for example from about 500 volts to about 5000 volts) sufficient to efficiently urge transfer of marking particle images from the intermediate image transfer member drum 20 to the receiver member S. At the same time, support roller 40 is electrically biased, for example to ground potential, or electrically connected to source 28 or a separate potential source 33***a*, to a level sufficient to eliminate ionization and premature transfer in the pre-nip region (that, is upstream of the nip 30). Reliable detack of the receiver members from the intermediate image transfer member drum 20 is achieved by supplying an adequate load to support roller 42, which as noted above is formed of a material which is substantially harder than the intermediate image transfer member outer layer 24, causing the outer layer to compress and form a substantially sharp interface of the web from the intermediate image transfer member (ITM). Moreover, the potential on the web 34 may be set to generate an attractive force between the web and the receiver member to assist in transport of the receiver member by the web. The receiver member, due to its inherent stiffness, thus detacks from the intermediate image transfer member drum 20 and follows the web until the web makes a sharp bend around support roller 44. The stiffness of the receiver member will then cause the receiver member to detack from the web and continue along a substantially straight line path where it will come under the influence of the transport 54 for further transport away from the web. Where a multiple color image is to be transferred to the receiver member, a multiple color image may be formed by overlaying in registered relationship separate color images to the outer layer 24 of the ITM. In such case, the web 34 and one cleaning device for cleaning the ITM may be moved out of engagement with the ITM during formation of the multicolor image on the ITM and moved into engagement with the ITM prior to movement of the receiver member into the transfer nip. In lieu of combining alternate toner color images, different types of toner images may be combined such as an image developed with non-magnetic toner and an image developed with a magnetic toner. Also contemplated is creating a multicolor toner image on an image frame of a photoconductor using tri-level xerography or other known multicolor writing systems.

Figure 2:
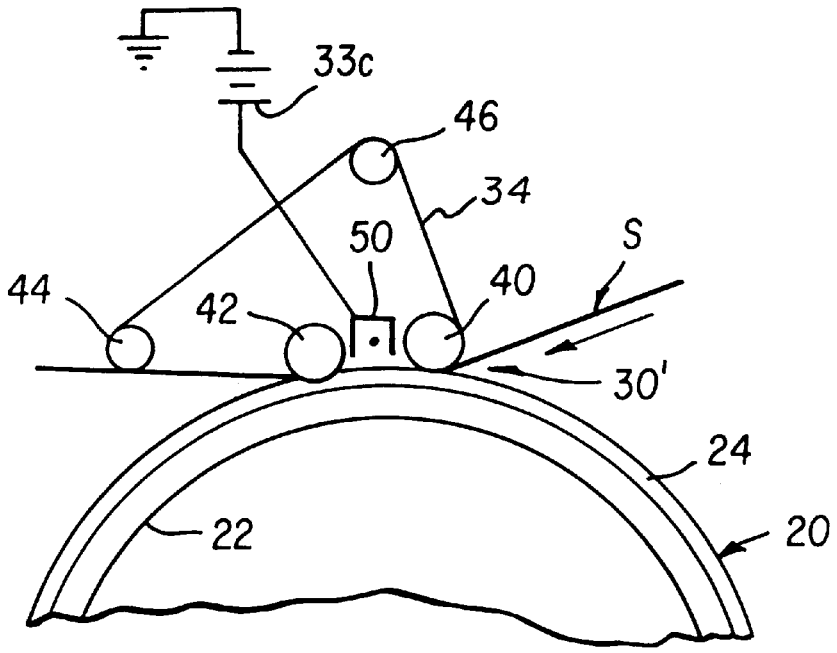
FIG. 2 is a side elevational view of the reproduction apparatus shown in FIG. 1. with an alternate embodiment for the endless web transfer facilitating mechanism.

FIG. 2 shows an alternate embodiment of the reproduction apparatus 10 according to this invention. The difference of the alternate embodiment of FIG. 2 from that of the embodiment shown in FIG. 1 is the way in which the transfer field is applied to the endless web 34. In this alternate embodiment, the endless web 34 is charged with a corona charger 50 to urge transfer of marking particles from the intermediate image transfer member drum 20 to the receiver member S. The charger 50 is located adjacent to the back side of the web 34 between the support rollers 40 and 42 (which define the transfer nip 30). The electric field that urges marking particle transfer is supplied by a corona charger 50 by spraying charge onto the back of the endless web over its run between support rollers 40 and 42. The power supply 33*c* controlling the charger 50 preferably operates at a constant current so that a controlled amount of charge is supplied to the web. In this manner the transfer of marking particles is insensitive to variations in the resistivity of the receiver member which can vary by many orders of magnitude depending on the paper type, whether it was recently fused or not, and the ambient relative humidity. In this embodiment, support rollers 40 and 42 may also be electrically biased, to a desired potential, in the manner described above.

Figure 3:
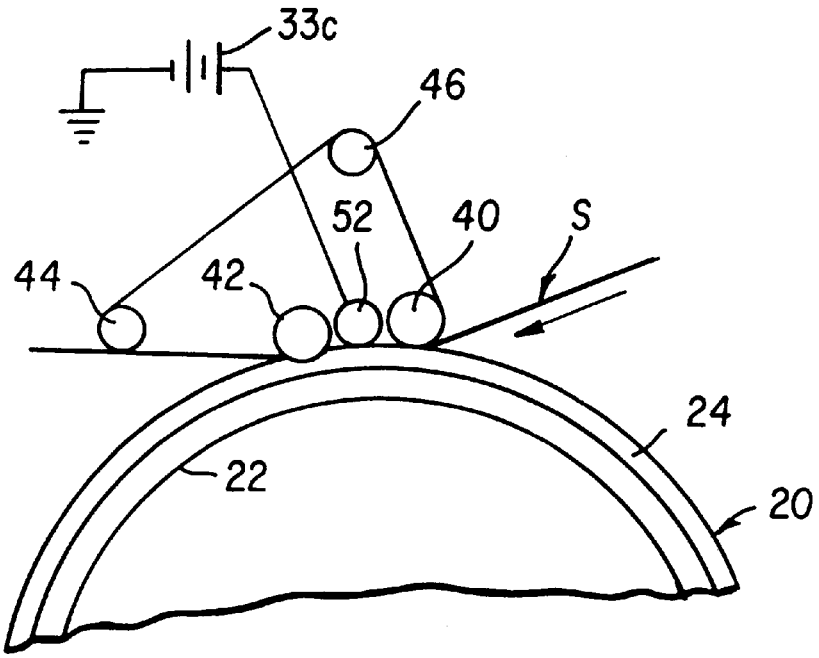
FIG. 3 is a side elevational view of the reproduction apparatus shown in FIG. 1. with another alternate embodiment for the endless web transfer facilitating mechanism.

FIG. 3 shows an alternate embodiment of the reproduction apparatus 10 according to this invention. Again, the difference of the alternate embodiment of FIG. 3 from that of the embodiment shown in FIG. 1 is the way in which the transfer field is applied to the endless web 34. In this embodiment, an additional roller 52 is located between the support rollers 40 and 42. The transfer field is largely determined by the electrical bias applied to the support roller 52 by the power supply 33*c*. The power supply 33*c* preferably operates at a constant current so that a controlled amount of charge is supplied to the support roller 52, and thus to the endless web 34. As discussed above, in this manner the transfer of marking particles is insensitive to variations in the resistivity of the receiver member. In this embodiment, once again, support rollers 40 and 42 may also be electrically biased, to a desired potential, in the manner described above.

In the embodiments of FIGS. 4–8, there is featured an insulating transfer member in conjunction with a compliant intermediate transfer member (ITM) and an additional transfer biasing mechanism for supplying an electrical bias behind the insulating transfer member in the transfer nip. Examples of the transfer biasing mechanism include roller chargers, corona chargers, biased blades or biased brushes. Substantial pressure is provided in the transfer nip to realize the benefits of the compliant intermediate transfer member which are conformation of the toned image to the receiver member and image content on both a microscopic and macroscopic scale. The pressure may be supplied solely by the transfer biasing mechanism or additional pressure applied by another member such as a roller, shoe, blade or brush. Preferably, the insulating transfer member is in the form of an insulating endless web (IEW) supported by 2 or more rollers.

In the preferred embodiment the IEW wraps the ITM to provide a nip for the transfer of toner from the ITM to receiver member or receiver sheet (e.g. paper, transparency, etc. preferably in sheet form) which runs between the web and ITM. The electric field that urges toner from the ITM to the receiver member is supplied to the backside of the IEW by a charging mechanism (e.g. a corona charger or roller charger) positioned in the transfer nip. Additional pressure can be applied in the transfer nip with a roller, brush blade or plate so that the compliant ITM conforms to the surface irregularities of the receiver member and the toner image content on the ITM. The pressure reduces air gaps near the toner and therefore allows for higher electric fields and improved toner transfer efficiency. The receiver member is removed from contact with the IEW or detacks from the web downstream from the transfer area opposite an IEW support roller. Discussed in detail below, various chargers may also be employed at other locations on the web to affect paper handling, web conditioning and paper detack. In each case a fuser (not shown) is located downstream of the last transfer station (if multiple ITMs are used) or the transfer station (if a single ITM is used) to fuse the toner image to the receiver member.

Figure 4:
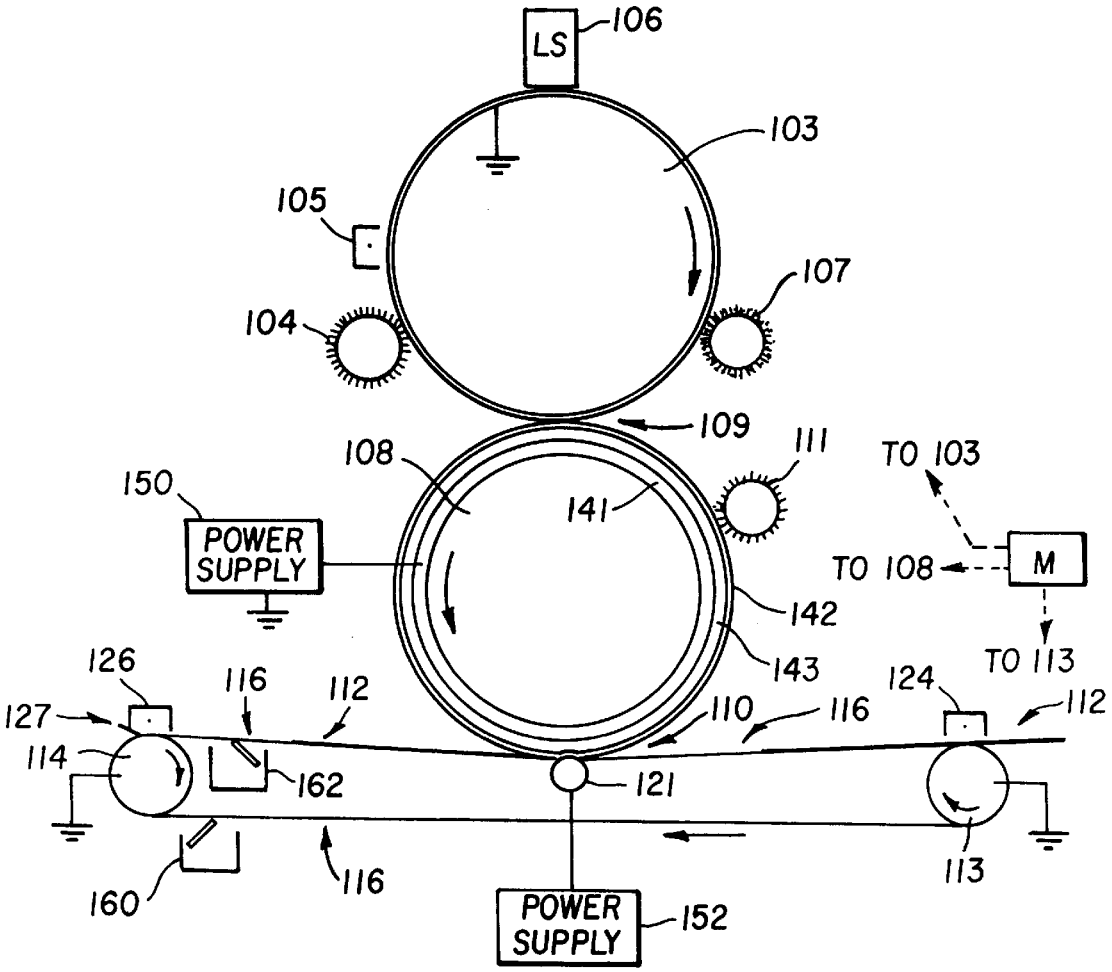
FIG. 4 is a side elevational view in schematic form of a fourth embodiment of the invention.

The compliant intermediate member used for the embodiments of FIGS. 4–9 are described in more detail by Tombs et al, U.S. application Ser. No. 08/572,559 and more preferably in U.S. application Ser. No. 08/846,056, filed in the name of Vreeland et al and is preferably in the form of a roller, i.e., substantially cylindrical. Referring to FIG. 4, the ITM 108 is comprised of an electrically conducting aluminum core 141, a relatively thick (1–20 mm) compliant blanket layer 143 and a relatively thin (2 $\mu$m–30 $\mu$m) hard overcoat layer 142. The Young's modulus of the blanket layer 143 is preferably between 0.1 and 10 MPa and its bulk or volume electrical resistivity is preferably between $10^7$–$10^{11}$ ohm-cm.

The Young's Modulus of the overcoat layer 142 is preferably greater than 100 MPa. The insulating endless web (IEW) is made of a thin (20 μm–1000 μm, preferably 50 μm–200 μm) flexible material such as polyvinylidene fluoride, polyethylene terephthalate, polyimides such as Kapton™ or a polyurethane or polycarbonate and has a bulk electrical resistivity greater than $1\times10^{12}$ ohm-cm. This bulk resistivity of the IEW is the resistivity of at least one layer of the IEW if the IEW is a multilayer article. Preferably, the top layer of the IEW which is in contact with the receiver member is the layer with the bulk resistivity of greater than $1\times10^{12}$ ohm-cm. The above-described characteristics of the ITM and IEW noted for FIG. 4 are also characteristic of the ITM and IEW in the embodiments of FIGS. 5–9.

With further reference to FIG. 4, a cylindrical photoconductive drum 103 is first cleaned by a cleaning station 104 then charged to a uniform potential with a corona charger 105 or other charger. The electrostatic latent image is written with an appropriate light source 106 after which the latent image is toned at toning station 107 with dry insulative toner particles (pigmented marking particles). The toned image is transferred from the photoconductor to the ITM 108 at nip 109. One or more images can be accumulated on the ITM in this manner. The electrically conductive core 141 of the ITM is biased by power supply 150 to affect transfer of the toner image from the photoconductive drum 103 to the ITM 108 in nip 109 and from the ITM to the receiver member or receiver sheet such as paper or plastic transparency material 112 in nip 110. Nip 110 is a region smaller than the wrap of the IEW 116 around the ITM 108. The total wrap may extend from 1–20 mm. The IEW 116 is supported by ground rollers 113 and 114. The receiver member 112 attaches to the IEW 116 at roller 114 with the aid of corona charger 126 which charges one surface (top shown) of the receiver member so that it is electrostatically held with its other surface in contact with the web. The grounded roller 114 supplies charge to the back side of the IEW 116. An optional blade 127 on the charger 126 ensures good contact of the receiver sheet with the IEW. When the receiver sheet enters nip 110, the backside of the IEW 116 is charged in the nip 110 with a roller charger 121 to electrostatically urge transfer of toner from the ITM 108 to the receiver sheet 112. A power supply 152 supplies sufficient electrical voltage bias, preferably at constant current, to roller 121. The roller 121 also supplies substantial pressure in the nip to aid transfer by reducing the size of microscopic air gaps in the nip caused by paper roughness, particulate contamination and image structure. The total wrap of the IEW around the ITM is preferably larger than a nip that would be achieved by the roller 121 alone (i.e. no IEW) allowing the wrap to exceed, by more than at least about 1 mm, the nip formed with roller 121 on each of the entrance and exit sides thereby reducing the amount of ionization in the pre-nip and post-nip regions. Downstream of nip 110 the receiver member 112 detacks from the IEW 116 at roller 113 with the aid of corona charger 124 which discharges the receiver member; for example, by applying a charge that will neutralize the charge on the top surface of the receiver member 112. Subsequently the toner image transferred from the ITM to the receiver member in the nip 110 is fused to the receiver member by a fuser (not shown). Both sides of the IEW 116 can be cleaned by any appropriate cleaner such as blades 160 and 162. A motor M and suitable drive mechanisms are provided for driving the various members in the directions indicated by the respective arrows showing movement. It is known in electrophotographic engines to provide drive to one component such as a belt so that the belt can frictionally drive a drum. A cleaner 111 cleans the surface of the ITM.

Figure 5:
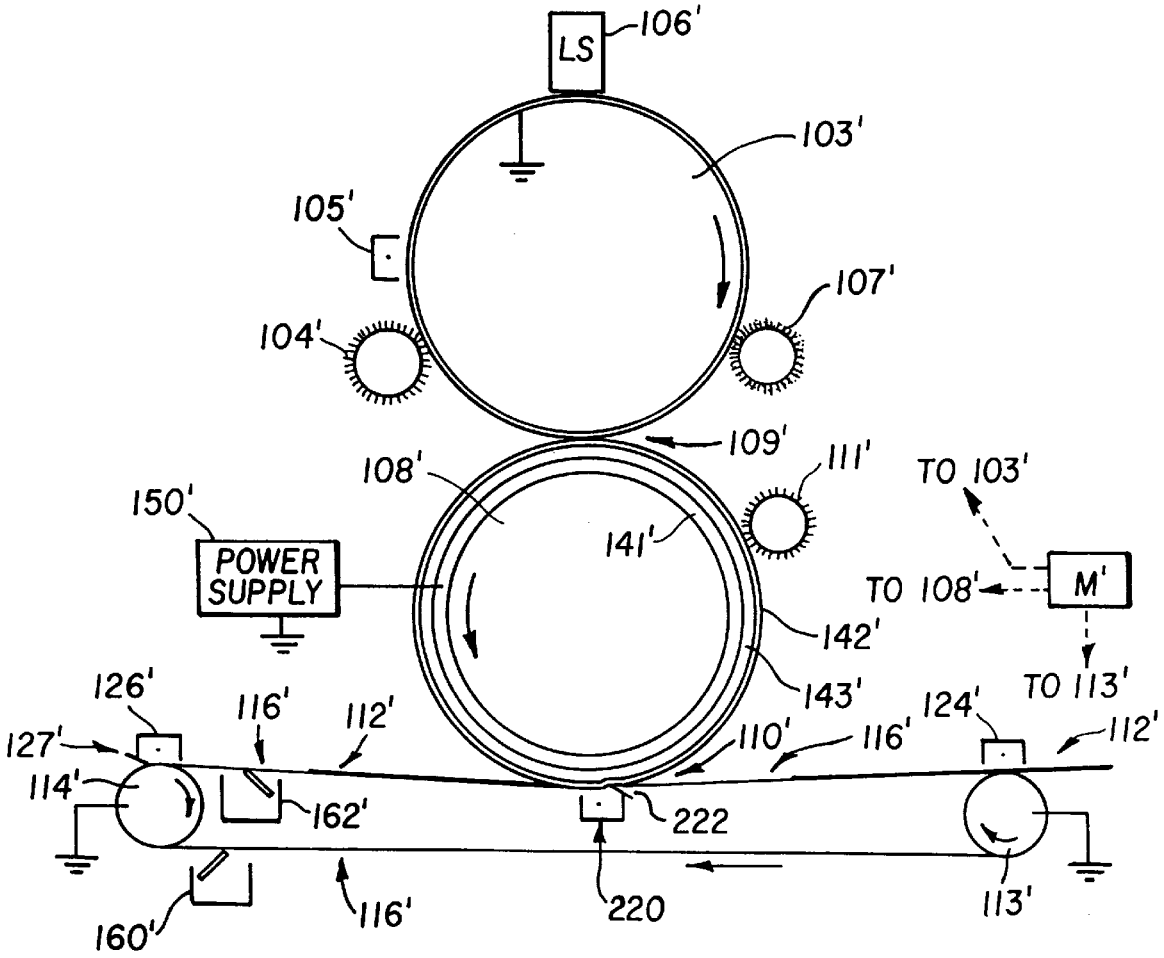
FIG. 5 is a side elevational view in schematic form of a fifth embodiment of the invention.

In the embodiment illustrated in FIG. 5, elements similar to that shown and described with reference to FIG. 4 are identified with a prime (′). The only difference from that of the embodiment of FIG. 4 is the means of applying the bias and pressure to the backside of the IEW 116′ in nip 110′. In the embodiment of FIG. 5, a corona wire charger 220 is used to supply charge to the backside of the web 116′ and a blade 222 is used to supply pressure in the nip 110′. A plate or other means could also be used instead of blade 222.

Figure 6:
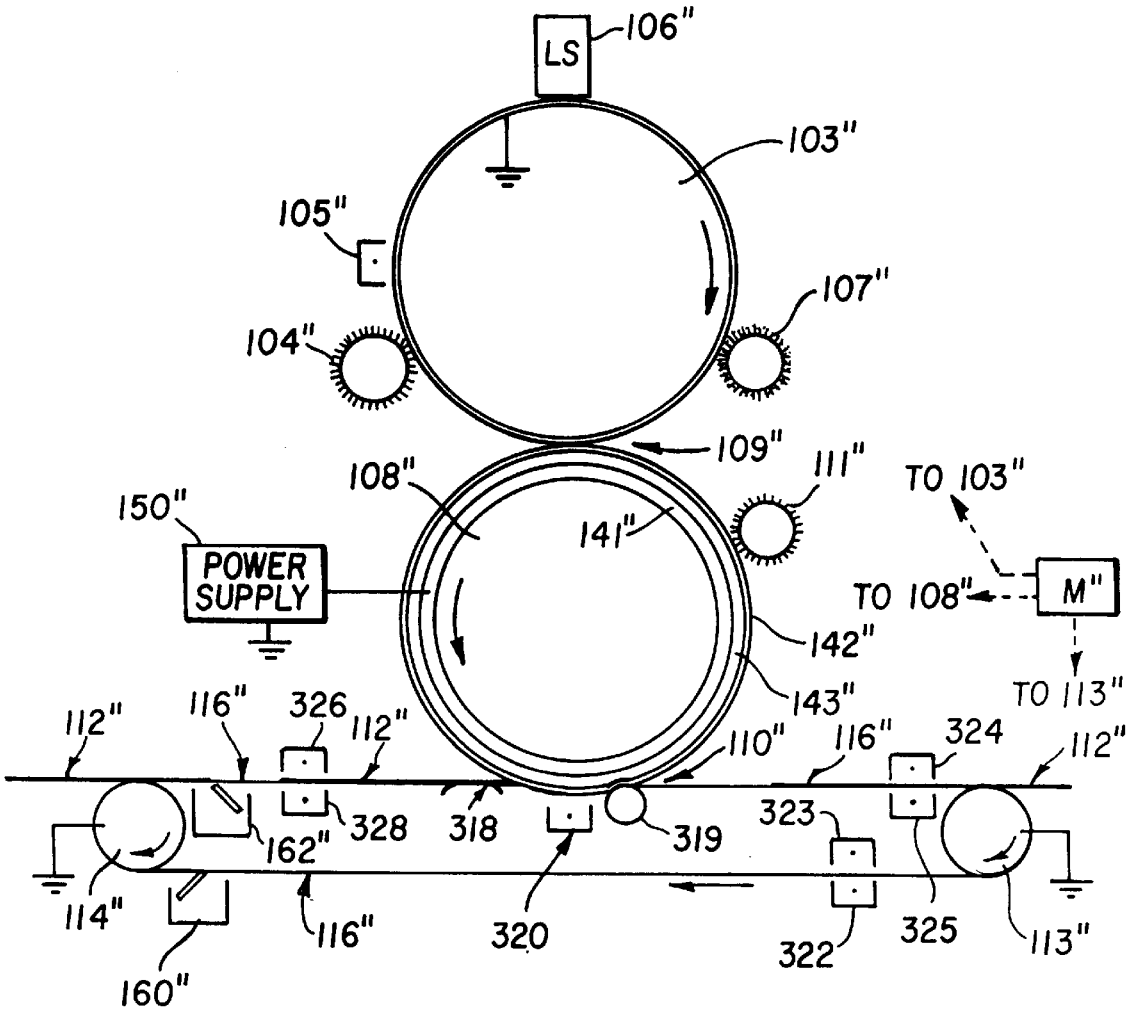
FIG. 6 is a side elevational view in schematic form of a sixth embodiment of the invention.

With reference now to the embodiment of FIG. 6, elements similar to that described with reference to FIG. 4 are identified with a double prime (″). The difference between the embodiments of FIG. 6 and the embodiment of FIG. 5 is the means of applying the pressure to the back side of the IEW 116″ in nip 110″. In the embodiment of FIG. 6, a separate roller 319 is used to apply pressure in the nip 110″. Plate 318 is used in conjunction with pressure roller 319 to define the nip 110″. Both plate 318 and roller 319 may be electrically biased to further improve toner transfer in nip 110″. Also, shown in FIG. 6 are alternate techniques for electrostatic paper hold down and paper detack. An opposing pair of corona chargers 326 and 328 on opposite sides of the IEW are used to respectively apply charge to the receiver member and to the underside of the IEW 116″ to electrostatically hold the receiver member 112″ to the IEW 116″ and a second pair of opposing chargers 324 and 325 are used to electrically discharge the receiver member 112″ and IEW 116″ to ensure detack. An additional opposing pair of corona chargers 322 and 323 are used to condition the IEW for the next cycle.

Figure 7:
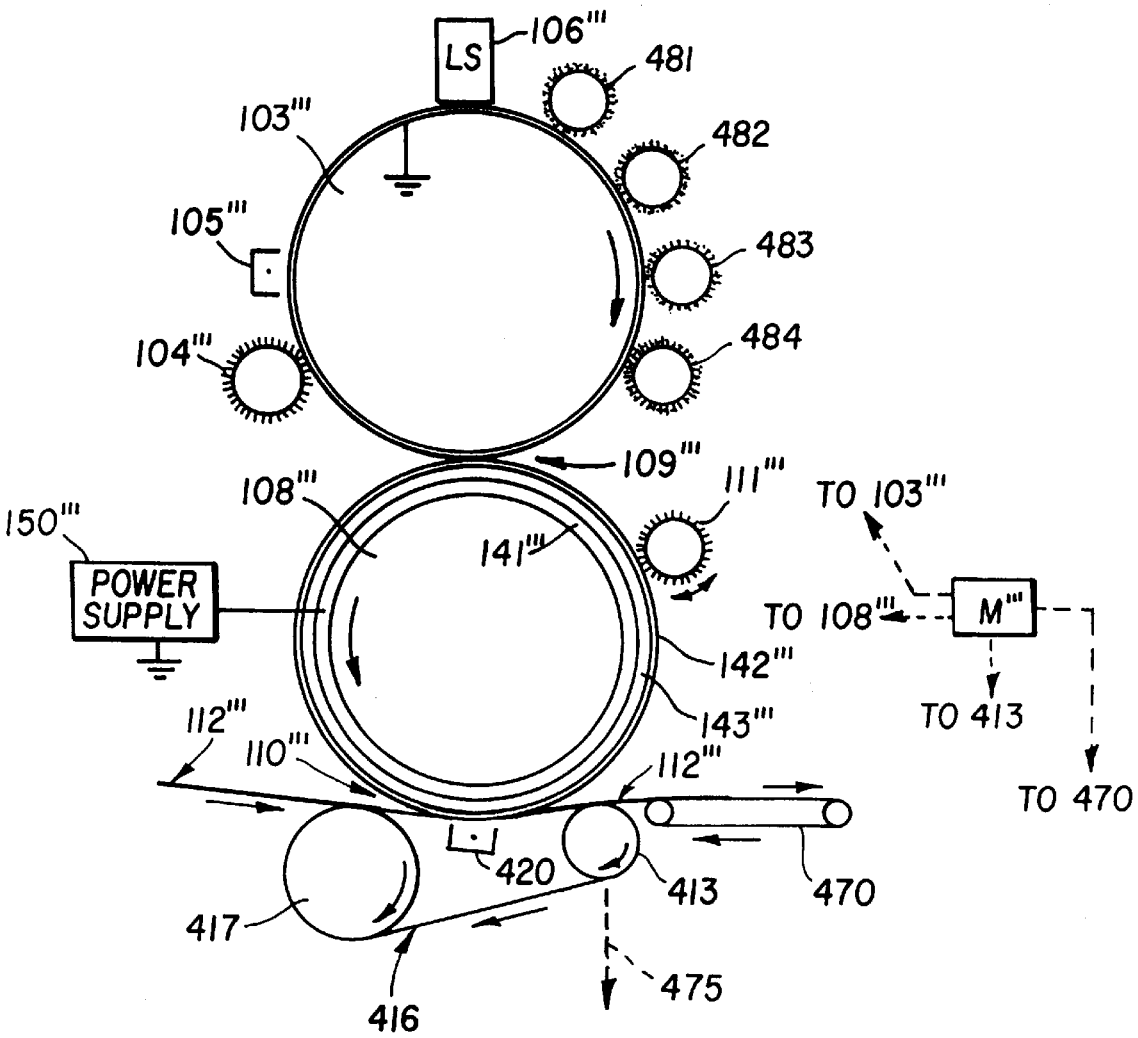
FIG. 7 is a side elevational view in schematic form of a seventh embodiment of the invention.

With reference now to the embodiment of FIG. 7, elements similar to that described with reference to FIG. 4 are identified with a triple prime (‴). The apparatus of FIG. 7 is a full color machine having 4 toning stations, 481, 482, 483, and 484, containing 4 different color toners, cyan, magenta, yellow, and black, respectively. The exposure station 106‴ separately exposes the uniformly charged photoconductive drum 103‴ with each color separation image. The color separated electrostatic images are developed with the respective color toners. A toned image from each developer station is sequentially transferred to the ITM in the manner described above except that all 4 toned images are collected in superimposed and registered relationship on the ITM while the IEW 416 is disengaged from the ITM 108‴ as indicated by arrow 475. The cleaner 111‴ is also removed from contact with the ITM during each of the four rotations of the ITM as the individual color toner images are transferred to the ITM. The cleaner is subsequently moved into cleaning relationship with the ITM after transfer of the last color image of the four-color images are transferred to the ITM. After the four color images are collected on the ITM or as the last of the four-color images is transferred to the ITM, the IEW 416 is moved to be engaged in contact with the ITM 108‴. The receiver member 112‴ is passed through the nip 110‴ in synchronization with movement of the images on the ITM and all 4 color images are simultaneously transferred to the receiver member. Rollers 417 and 413 define the transfer nip by causing the IEW 416 to wrap the ITM 108‴. Charge to create the transfer field is deposited on the backside of the IEW by corona charger 420. The IEW supplies the needed pressure in the transfer nip and the pressure is set by specifying the web tension. Roller 413 is small to ensure detack of the receiver member from the IEW. A transport mechanism 470 acquires and transports the print media away from the IEW.

Figure 8:
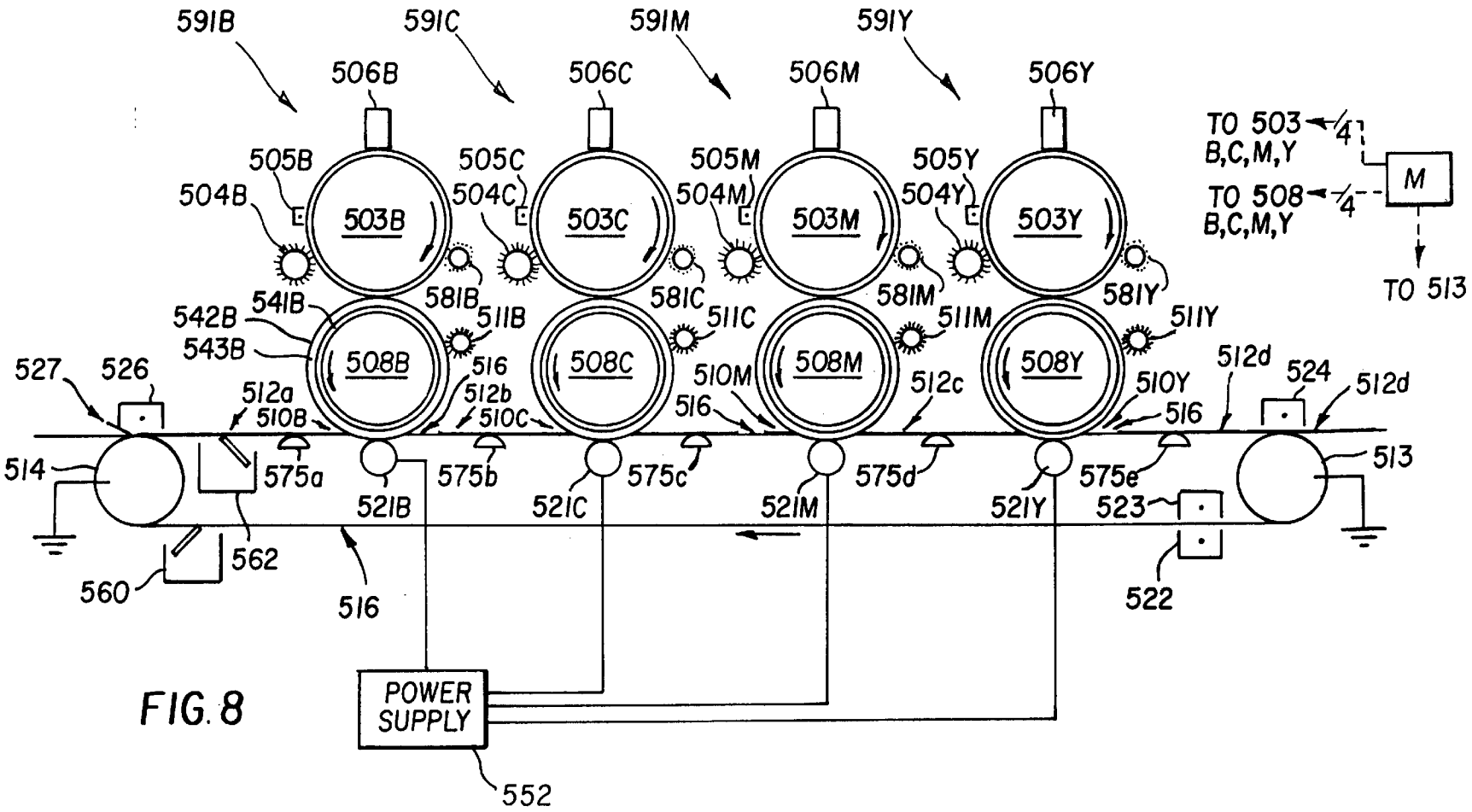
FIG. 8 is a side elevational view in schematic form of an eighth embodiment of the invention.

The apparatus shown in FIG. 8 is also a full color machine but the electrophotographic modules work in parallel. Each electrophotographic module 591B, C, M, and Y produces a different color and all operate simultaneously to construct 4 color image. In this embodiment the IEW 516 serially transports the receiver members 512*a*, 512*b*, 512*c* and 512*d* through nips 510 B, C, M and Y formed by the ITMs of each module where each color is transferred in turn to a respective receiver member so that each receiver member receives up to four superposed registered color images to be formed on one side thereof. Registration of the various stations application of color to the receiver member may be provided by various well known means such as by controlling timing of entry of the receiver in the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. While not shown, suitable controls can be provided using programmed computers and sensors including encoders which operate with same as is well known in this art.

In the embodiment of FIG. 8, each module is of similar construction to that shown in FIG. 4 except that as shown one IEW 516 operates with all the modules and the receiver member is transported by the IEW from module to module. The elements in FIG. 8 that are similar to that shown in FIG. 4 have 400 added to their reference numerals with a suffix of B, C, M and Y referring to the color module to which it is associated. Four receiver members or sheets 512*a, b, c* and *d* are shown receiving images from the different modules, it being understood as noted above that each receiver member may receive one color image from each module and that up to four color images can be received by each receiver member. The movement of the receiver member with the IEW is such that each color image transferred to the receiver member at the transfer nip of each module formed with the IEW is a transfer that is registered with the previous color transfer so that a four-color image formed in the receiver member has the colors in registered superposed relationship on the receiver member. The receiver members are then sent to a fusing station (not shown) as is the case for all the embodiments to fuse the dry toner images to the receiving member. The IEW is reconditioned by providing charge to both surfaces by opposed corona chargers 522, 523 which neutralize charge on the surfaces of the IEW.

In the embodiment of FIG. 8, a receiver member may be engaged at times in more than one image transfer nip and preferably is not in the fuser nip and an image nip simultaneously. The path of the receiver member for serially receiving in transfer the various different color images is generally straight facilitating use with receiver members of different thickness. Support structures 575*a, b, c* and *d* are provided before entrance and after exit locations of each transfer nip to engage the IEW on the backside and alter the straight line path of the IEW to provide for wrap of the IEW about each respective ITM so that there is wrap of the IEW of greater than 1mm on each side of the nip. This wrap allows for reduced pre-nip and post-nip ionization. The nip is where the pressure roller contacts the backside of the web or where no roller is used where the electrical field is substantially applied but still a smaller region than the total wrap. The wrap of the IEW about the ITM also provides a path for the lead edge of the receiver member to follow the curvature of the ITM but separate from engagement with the ITM while moving along a line substantially tangential to the surface of the cylindrical ITM. Pressure of the support rollers 521 B, C, M and Y upon the backside of the IEW faces the surface of the compliant ITM to conform to the contour of the receiver member during transfer. Preferably, the pressure of the support rollers on the IEW is 7 pounds per square inch or more and it is also preferred to have the support rollers have a layer whose hardness is in the same range for the compliant layer of the ITM noted above.

An additional advantage to the embodiment of FIG. 8 is that the development stations 581 B, C, M and Y may be, because of their relative locations where they develop their respective photoconductive drums, more suited for operation with preferred known development stations using so called "SPD development" described by Miskinis (IS&T's Sixth International Congress on Advances in Non-Impact Printing Technologies, pp. 101–110 published in 1990). In this process the developer in the respective development stations is comprised of relatively small "hard" magnetic carrier particles (approximately 30 $\mu$m in diameter, as opposed to over 100 $\mu$m in diameter for conventional two-component development systems) which form chains around the development roller in the development station. The term "hard" implies particles having a coercivity of at least 300 oersteds when magnetically saturated and exhibiting an induced magnetic moment of at least 20 EMU/gm of carrier when in an applied field of 1000 oersteds. It is preferred to have carrier having a much higher coercivity in the neighborhood of 2000 oersteds. In this method, developer made up of such hard magnetic carrier particles and oppositely charged insulative, dry toner particles is moved at the speed and direction of the image by high speed rotation of a magnetic core within a shell or sleeve on which the developer moves. It is preferred that the core be comprised of between 8 and 20 permanent magnets rotating between 300 and 1500 rpm. The shell speed is set so that the developer flow rate matches the velocity of the photoconductor. Rapid pole transitions on the sleeve cause the high coercivity carrier to experience a torque. "Strings" or "chains" of the carrier rapidly flip on the sleeve to move the developer on the shell in a direction opposite to that of the rotating core. In contrast, a low coercivity, "soft" magnetic carrier will internally magnetically re-orient in response to the pole transitions and not experience a torque adequate to cause carrier chains to flip. Because carrier particles, to which the toner particles are attached, tend to flip as the magnetic core turns, there is imparted kinetic energy to the toner particles.

In order to provide for a compact apparatus, it is desirable to minimize spacing between modules in the embodiment of FIG. 8. However, this configuration allows for an SPD development station to be positioned, with reasonable compactness of the apparatus, at a region on the photoconductive drum equivalent to between the 4 o'clock and 8 o'clock positions of the respective photoconductive drum as illustrated in FIG. 8 wherein the development stations are shown respectively at about the 4 o-clock positions of the respective photoconductive drum.

Figure 9:
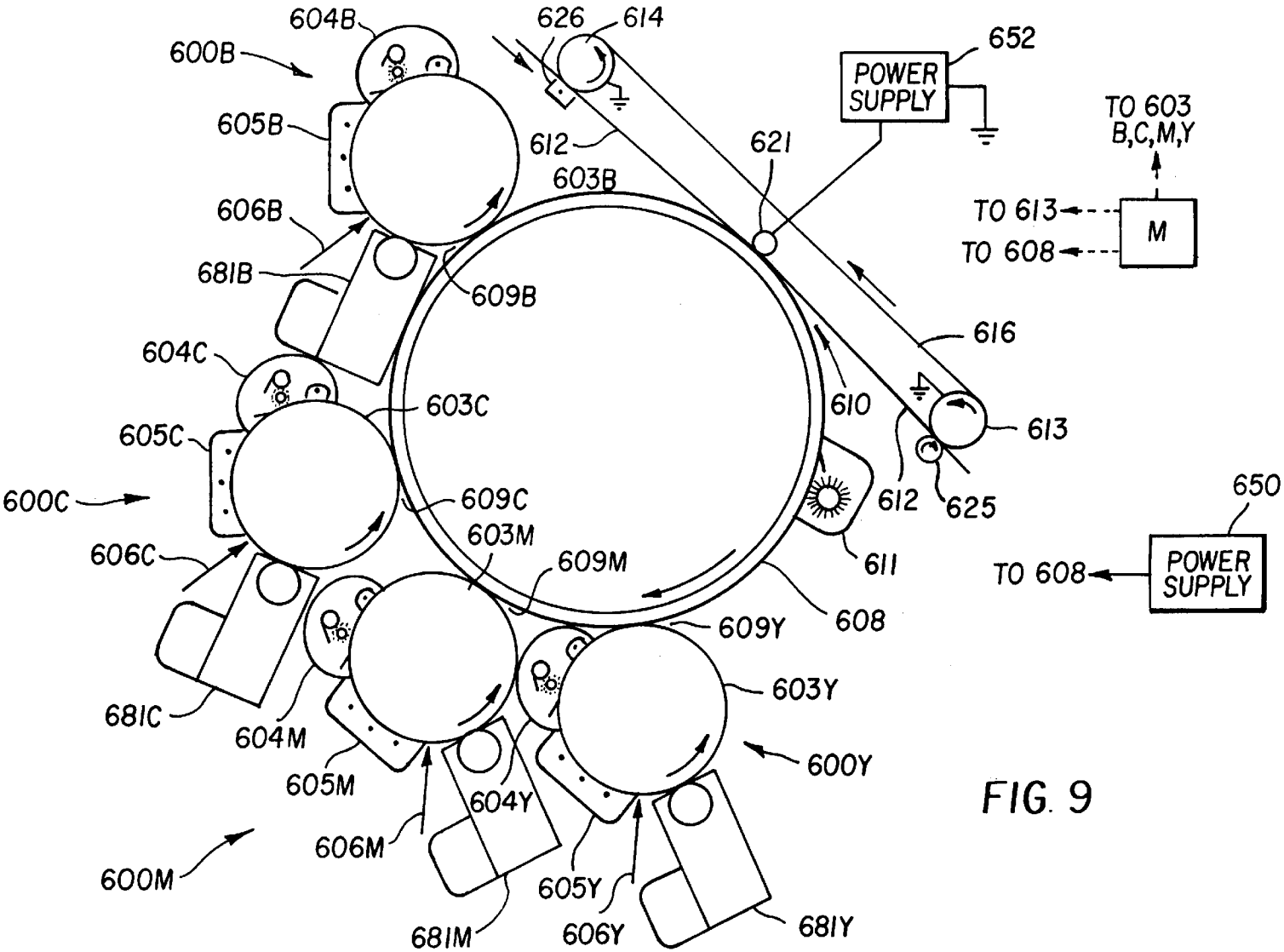
FIG. 9 is a side elevational view in schematic form of a ninth embodiment of the invention.

In FIG. 9, still another alternate embodiment is illustrated. In this embodiment, a full four-color electrophotographic apparatus or machine is illustrated. The apparatus includes an ITM 608 having the characteristics of the ITM's described above; i.e., it is in the form of a rotating cylindrical roller or drum and is comprised of an electrically conducting aluminum core, a relatively thick (1–20 mm) compliant blanket layer formed over the core and a relatively thin (2 $\mu$m–30 $\mu$m) hard overcoat layer over the compliant layer. The characteristics of the various layers of the ITM (thickness, hardness and resistivity) are identical to the characteristics described above for the embodiment of FIG.

4. An IEW 616 is also provided as shown and also has the characteristics of the IEW for the embodiment of FIG. 4. Tension in the IEW is provided by support rollers 613, 614 about which the belt is entrained. The tension in the IEW, as in the other embodiments, may be provided by springs or other locating elements operating on the support rollers 613, 614 so as to establish a tension in the IEW so that where the IEW 616 engages the ITM 608 there is as in the other embodiments a partial wrapping of the IEW about the ITM in the nip area 610. Additional pressure is provided by electrically biased roller 621 which engages the backside of the IEW at the nip area 610 and pressingly urges the IEW into intimate engagement with the ITM so that wrapping of the IEW about the ITM is preferably more than the actual transfer nip area. A power supply 652 provides preferably a constant current and electrical voltage bias to transfer a multicolor toner image to a receiver member 612 supported on the IEW and moved into the nip 610. The ITM 608 is also electrically biased by a power supply 650 which provides at nip 610, in cooperation with the electrical voltage bias on roller 621, an electrical field suited for transfer of the multicolor toner image to the receiver member 612 in the nip 610. Drive to the various components, in particular the IEW 616, ITM 608, photoconductive drums 603 B, C, M and Y, and various cleaning and development stations may be provided by a motor (M) and suitable drive members as is well known. A receiver member 612 is fed from a suitable supply of sheets to the transfer station. It is moved into engagement with the IEW 616 and electrostatically charged by charger 626 which applies charge to one surface of the receiver member as shown to cause the opposite surface to be electrostatically held in contact with the IEW. The receiver member then is transported by the IEW into the nip 610 for transfer of the multicolor image to the receiver member. After transfer of the toner image to the receiver member 612, the receiver member is conveyed by the IEW 616 into the nip between support roller 613 and a detack roller 625. An electrical bias is provided on detack roller 625 by a suitable power supply to neutralize charge on the receiver member so that the receiver member can be fed or transported into a fuser station (not shown) which may include a pair of fusing rollers, one of which is heated for fixing or fusing of the multicolor toner image to the receiver member. The receiver member is then as in the other embodiments, conveyed to a location, such as a tray, external to the machine for storing completed copy sheets. Provision may also be made for returning the receiver member so that the opposite side thereof may receive an image to create a duplex copy as is well known.

In order to form the multicolor toner image on the ITM, there are provided four primary image-forming modules 600 B, C, M and Y for forming color separation images in black, cyan, magenta and yellow, respectively. The four modules are essentially identical and a description of the components forming one of the modules is applicable to the others. However, it is known because of differences in properties between the different color toners to use different development station biases and other charging parameters and/or transfer biases. It is also known to have the black development station be larger since black toner is typically used in greater amounts than the other color toners.

The first primary image-forming module 600 Y includes a rotating drum type photoconductor 603Y that includes a photoconductive layer on or near the surface thereof. A belt or web-type photoconductor may also be used. A primary charger 605 Y establishes a uniform electrostatic charge on the surface of the photoconductor 603 Y. An imaging source indicated by arrow 606Y exposes the surface to modulate the electrostatic charge with color separation information to form a latent image to be developed with yellow toner. As noted above, the imaging source may be a laser, LED or other electro-optic, magneto-optic, liquid crystal, digital micrometer device or other spatial light modulator devices or the exposure may be an optical exposure. The latent image is developed with yellow toner at toning station 606 Y and this developed toner image is electrostatically transferred to the outer surface of the rotation ITM 608 at transfer nip 609 Y. Transfer of the toner to the ITM is provided by an electrical field between the photoconductive drum and the ITM. Untransferred toner is removed from the surface of the photoconductor 603 Y at a cleaning station 604 Y.

After the yellow toner image is transferred to the ITM the ITM continues to rotate and the developed magenta toner separation color image formed on photoconductive drum 603 M is transferred to the ITM in register with the yellow toner separation image. Similarly, the cyan and black developed toner separation images are transferred to the ITM in register with the previously applied yellow and magenta toner images to form the four color or multicolor image.

After transfer of the multicolor image formed on the ITM to the receiver member 612 the ITM is cleaned at a cleaning station 611 to prepare the ITM for receipt of the next toner image.

In the various color embodiments described the apparatus may also be used to form single color images or color images in various combinations of color in addition to the four-color image described.

In some of the described embodiments, the wrap of the belt that supports the receiver member in contact with the ITM is defined by tension in the transfer belt. The actual transfer nip where the major portion of the electrical field exists between the ITM and the roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transfer belt or IEW is substantially insulative. As noted above, it is preferred to have the wrap be greater than 1mm beyond the roller nip in at least the pre-nip area. Where a roller is used to apply the pressure to the underside of the belt to urge the receiver member into intimate contact with the ITM at the nip, it is preferred that the roller (121, 521B-Y, 621) be of intermediate conductivity, i.e. resistivity of $10^7$–$10^{11}$ ohm-cm, however, rollers that are highly conductive; i.e., having conductivity of a metal, also may be used. Other structures, as noted above, in lieu of rollers may be used to apply pressure to the web at the nip including members having conductive fibers that are electrically biased and provided with stiffener structure on either side of the brush for applying pressure to the web, or rollers with conductive fibers.

In the embodiments described above, transfer of the image to the ITM and from the ITM to the receiver member is made electrostatically and preferably without addition of heat that would cause the toner to soften. Thus, no fusing occurs upon transfer of the toner image to the receiver member in the nip between the IEW or transfer support belt and the ITM. In the forming of plural color images in registration on a receiver sheet, the invention contemplates that plural color toner images may be formed on the same image frame of the photoconductive image member using well known techniques; see, for example Gundlach, U.S.

Pat. No. 4,078,929. The primary imaging member may form images by using photoconductive elements as described or dielectric elements using electrographic recording. The toners used for development are preferably dry toners that are preferably non-magnetic and the development stations are known as two-component development stations. Single component developers may be used but as noted, are not preferred. While not preferred, liquid toners may also be used.

Other charging means such as rollers may be used instead of the corona wire chargers used for electrostatically holding the receiver member or print media to the web and for electrically discharging the receiver member.

In the color embodiments described herein, it is preferred to use dry, insulative toner particles having a mean volume weighted diameter of between about 2 $\mu$m and about 9 $\mu$m. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass.

The reproduction apparatus including the mechanism for facilitating transfer of a marking particle image from an intermediate image transfer member to a receiver member, according to this invention, is not limited to the particular geometry of the endless web arrangement of the transfer backing member as shown in the figures. A person skilled in the art would be able to realize the benefits of this invention with many different configurations.

The invention has been described in detail with particular reference to presently preferred embodiments, but it will be understood that variations and modifications can be effected within the spirit and scope of the invention.

What is claimed is:

1. A reproduction apparatus comprising:

a primary image forming member for forming a marking particle image;

a moving intermediate image transfer member operatively associated with said primary image forming member for transfer of the marking, particle image from the primary image forming member to the intermediate image transfer member;

means for electrostatically transferring a marking particle image formed on said primary image forming member from said primary image forming member to said intermediate image transfer member;

a moving, web supported in nip relation with said intermediate image transfer member for supporting a receiver member in a nip between the web and the intermediate image transfer member;

means for establishing an electrical transfer field in said nip for electrostatically transferring a marking particle image to the receiver member brought into intimate contact with said intermediate image transfer member in said nip; and wherein a wrap of the web about the intermediate image transfer member exceeds by at least 1 mm the nip at each of entrance and exit sides of the nip.

2. The reproduction apparatus according to claim 1 wherein said web is an endless web and has a bulk resistivity greater than $1\times10^5$ ohm-cm.

3. The reproduction apparatus according to claim 1 wherein said web is an endless web and is supported by a support roller which applies pressure to said web to urge said web into nip relation with said intermediate image transfer member, and wherein the means for establishing an electrical transfer field in said nip includes an electrical potential source connected to said support roller.

4. The reproduction apparatus according to claim 1 wherein said web is an endless web and is supported by first and second support members, and said source for establishing an electrical transfer field in said nip includes a corona charger in operative association with said intermediate image transfer member between the first and second support members.

5. The apparatus of claim 1 wherein said intermediate image transfer member includes a compliant layer having a Young's modulus in the range of between 0.1 MPa and 10 MPa and said web has a bulk resistivity greater than $1\times10^{12}$ ohm-cm.

6. The reproduction apparatus according to claim 1 wherein said web is an endless web, the apparatus includes a first support roller and a second support roller, and said endless web is supported by the first and second support rollers so that the web is in nip relation with said intermediate image transfer member, and said means for establishing an electrical transfer field in said nip includes a corona charger in operative association with said intermediate image transfer member between the first and second support rollers.

7. The reproduction apparatus according to claim 6 wherein said second support roller is upstream of said first support roller relative to movement of said web and is connected to an electrical potential source to establish an electrical field to prevent pre-nip ionization.

8. The reproduction apparatus according to claim 1 wherein said web has a bulk resistivity greater than $1\times10^{12}$ ohm-cm.

9. The reproduction apparatus according to claim 8 wherein a corona charger is provided for discharging any residual charge on the web remaining once the receiver member has been removed from the web.

10. The reproduction apparatus according to claim 1 and including a charging device positioned to charge the receiver member prior to entrance into the nip to attract the receiver member to the web.

11. A reproduction apparatus comprising:

a primary image forming member for forming a marking particle image;

a moving intermediate image transfer member operatively associated with said primary image forming member for transfer of the marking particle image from the primary image forming member to the intermediate image transfer member;

means for electrostatically transferring a marking particle image formed on said primary image forming member from said primary image forming member to said intermediate image transfer member;

a moving web supported in nip relation with said intermediate image transfer member for supporting a receiver member in a nip between the web and the intermediate image transfer member;

means for establishing an electrical transfer field in said nip for electrostatically transferring a marking particle image to the receiver member brought into intimate contact with said intermediate image transfer member in said nip;

wherein said web has a bulk resistivity greater than $1\times10^{12}$ ohm-cm; and wherein there is a wrap of the web about the intermediate image transfer member and the wrap is at a pre-nip location so that the web engages the intermediate image transfer member at a location at least 1 mm before the nip.

12. A reproduction apparatus comprising:

a primary image forming member for forming a marking particle image;

a substantially cylindrical intermediate image transfer member operatively associated with said primary image forming member for transfer of the marking particle image from the primary image forming member to the intermediate image transfer member;

means for electrostatically transferring a marking particle image formed on said primary image forming member from said primary image forming member to said intermediate image transfer member;

an endless web arrangement including an endless web that is moving in a direction for advancing a receiver member through a transfer nip, a plurality of support members about which said endless web is entrained, the transfer nip being between said intermediate image transfer member and said endless web member, said plurality of support members for said endless web including a support roller, said endless web being supported by the support roller in nip relation with said intermediate image transfer member and means for establishing an electrical transfer field in said nip for electrostatically transferring a marking particle image to a receiver member brought into intimate contact with said intermediate image transfer member in said nip, said means for establishing an electrical transfer field in said nip including an electrical potential source coupled to said support roller;

wherein said intermediate image transfer member includes a compliant layer that has a Young's Modulus in the range of between 0.1 MPa and 10 MPa and said compliant layer of said intermediate image transfer member is of a thickness in the range of between 2 mm and 15 m;

wherein said support roller is located in substantial pressure contact with said intermediate image transfer member to compress said compliant layer of said intermediate image transfer member; and wherein said support roller has an outer surface with a Young's Modulus substantially greater than the Young's Modulus of said compliant layer of said intermediate image transfer member, and is of a relatively smaller diameter than said intermediate image transfer member.

13. The reproduction apparatus according to claim 12 wherein a wrap of the web about the intermediate image transfer member exceeds by at least 1 mm the nip at each of entrance and exit sides of the nip.

14. The reproduction apparatus according to claim 12 wherein said compliant layer of said intermediate image transfer member has a Young's Modulus in the range of between 1 MPa and 5 MPa.

15. The reproduction apparatus according to claim 12 wherein said endless web has a bulk resistivity greater than $1\times10^5$ ohm-cm.

16. A reproduction apparatus comprising:

a primary image forming member;

a substantially cylindrical intermediate image transfer member engaged with said primary image forming member;

means for electrostatically transferring a marking particle image formed on said primary image forming member from said primary image forming member to said intermediate image transfer member;

an endless web arrangement including an endless web that is moving in a direction for advancing a receiver member through a transfer nip, a plurality of support members about which said endless web is entrained, the transfer nip being between said intermediate image transfer member and said endless web member, said plurality of support members for said endless web including a support roller, said endless web being supported by the support roller in nip relation with said intermediate image transfer member and means for establishing an electrical transfer field in said nip for electrostatically transferring a marking particle image to a receiver member brought into intimate contact with said intermediate image transfer member in said nip, said means for establishing an electrical transfer field in said nip including an electrical potential source coupled to said support roller;

wherein said intermediate image transfer member includes a compliant layer having a Young's Modulus in the range of between 0.1 MPa and 10 MPa;

wherein said endless web has a bulk resistivity greater than $1\times10^5$ ohm-cm; and wherein said support roller has a layer which has a compliancy within the range of 0.1 MPa to 10 MPa.

17. The reproduction apparatus according to claim 16 wherein said support roller has an outer surface with a Young's Modulus substantially greater than the Young's Modulus of said compliant layer of said intermediate image transfer member, and is of a relatively smaller diameter than said intermediate image transfer member.

18. A reproduction apparatus comprising:

a primary image forming member;

a substantially cylindrical intermediate image transfer member operatively associated with said primary image forming member;

means for electrostatically transferring a marking particle image formed on said primary image forming member from said primary image forming member to said intermediate image transfer member;

an endless web arrangement including an endless web that is moving in a direction for advancing a receiver member through a transfer nip, a plurality of support members about which said endless web is entrained, the transfer nip being between said intermediate image transfer member and said endless web member, said plurality of support members for said endless web including a support roller, said endless web being supported by the support roller in nip relation with said intermediate image transfer member and means for establishing an electrical transfer field in said nip for electrostatically transferring a marking particle image to a receiver member brought into intimate contact with said intermediate image transfer member in said nip, said means for establishing an electrical transfer field in said nip including an electrical potential source coupled to said support roller; and wherein said support roller is a first support roller and said plurality of support members for said endless web further includes a second support roller, said endless web being supported by said second support roller in nip relation with said intermediate image transfer member, at a position upstream of said first support roller, and wherein an electrical potential source is connected to said second support roller to establish an electrical field to prevent pre-nip ionization, the position upstream being in relation to the direction of movement of the endless web.

19. A reproduction method comprising:

forming a marking particle image on a primary image forming member;

transferring the marking particle image formed on said primary image forming member from said primary image forming member to a cylindrical surface of an intermediate image transfer member;

advancing a receiver member into a nip defined between an endless web and said intermediate image transfer member, and establishing an electrical transfer field in said nip for electrostatically transferring the marking particle image to the receiver member brought into intimate contact with said intermediate image transfer member in said nip; and supporting the web at supports that are at locations at or near an entrance portion and at or near an exit portion of the nip to provide wrap of the web about the intermediate transfer member that extends beyond the nip.

20. The reproduction method according to claim 19 wherein said intermediate image transfer member includes a compliant layer having a Young's Modulus in the range of between 0.1 MPa and 10 MPa.

21. The reproduction method according to claim 20 wherein the compliant layer of said intermediate image transfer member is of a thickness of greater than 1 mm.

22. The reproduction method according to claim 20 wherein said compliant layer of said intermediate image transfer member is of a thickness in the range of between 2 mm and 15 mm.

23. The reproduction method according to claim 19 wherein said endless web has a bulk resistivity greater than $1\times10^{5}$ ohm-cm.

24. The reproduction method according to claim 19 wherein said endless web has a bulk resistivity greater than $1\times10^{12}$ ohm-cm.

25. The reproduction method according to claim 24 wherein said endless web is supported in nip relation with said intermediate image transfer member by a support roller, and wherein an electric potential is established between said support roller and the intermediate image transfer member.

26. The reproduction method according to claim 19 wherein said intermediate image transfer member has a compliant layer with a Young's Modulus in the range between 1 MPa and 5 MPa.

27. The reproduction method according to claim 19 wherein a corona charger operates in establishing the electric transfer field in the nip and the charger applies charge on a backside portion of the web.

28. The reproduction method according to claim 27 wherein the web is held in engagement with the intermediate transfer member in the nip by a structure which engages the backside of the web at a location proximate to where the charger applies charge on the backside of the web.

29. The reproduction method according to claim 19 wherein the web is held in engagement with the intermediate transfer member in the nip by a structure which engages the backside of the web under pressure and the intermediate image transfer member deforms in the nip.

30. The reproduction method according to claim 29 wherein said intermediate image transfer member includes a compliant layer that has a Young's Modulus in the range of between 1 MPa and 5 MPa and said compliant layer of said intermediate image transfer member is of a thickness in the range of between 2 mm and 15 mm.

31. The reproduction method according to claim 19 and including serially transferring plural different marking particle images of respective plural different colors to said intermediate image transfer member in superposed registration on said intermediate image transfer member to form a multicolor image on the intermediate image transfer member.

32. The reproduction method according to claim 31 wherein said endless web has a bulk resistivity greater than $1\times10^{12}$ ohm-cm.

33. A reproduction method comprising:

forming a marking particle image on each of a plural number of primary image forming members, images on the plural number of members being in different respective colors;

transferring the marking particle image formed on each of the primary image forming members to a surface of a respective intermediate image transfer member, each primary image forming member being associated with a respective different intermediate image transfer member;

advancing a receiver member serially into respective nips defined between one endless web and the plural number of intermediate image transfer members;

establishing electrical transfer fields in the nips for serially electrostatically transferring in superposed registration the marking particle images to the receiver member serially brought into intimate contact with the intermediate image transfer members in the nips; and wherein each intermediate image transfer member is cylindrical and the endless web is partially wrapped about each intermediate image transfer member.

34. The reproduction method according to claim 33 and supporting the web at supports that are at locations at or near an entrance portion and at or near an exit portion of each of the nips to provide wrap of the web about each respective intermediate transfer member that extends beyond each nip.

35. The reproduction method according to claim 33 wherein the endless web has a bulk resistivity greater than $1\times10^{12}$ ohm-cm.

36. The reproduction method according to claim 35 wherein said endless web is supported in nip relation with each respective intermediate image transfer member by a respective support roller, and wherein a respective electrical potential is established between each respective support roller and each intermediate image transfer member.

37. The reproduction method according to claim 35 wherein at least one of said intermediate image transfer members includes a compliant layer having a Young's Modulus in the range of between 0.1 MPa and 10 MPa.

38. The reproduction method according to claim 37 wherein the compliant layer of said one intermediate image transfer member is of a thickness of greater than 1 mm.

39. The reproduction method according to claim 37 wherein said compliant layer of said one intermediate image transfer member is of a thickness in the range of between 2 mm and 15 mm.

40. The reproduction method according to claim 37 wherein said compliant layer of said one intermediate image transfer member has a Young's Modulus in the range of between 1 MPa and 5 MPa.

41. The method of claim 33 and wherein the web is supported between intermediate image transfer members, and a receiver member leaves contact with an intermediate image transfer member as the receiver member moves along a line substantially tangent to the intermediate image transfer member.

42. The method of claim 33 wherein the endless web is partially rapped about each intermediate image transfer member so that there is contact of the web with each intermediate image transfer member at a location at least 1 mm from the nip.

43. The reproduction method of claim 33 and wherein the web is supported between intermediate image transfer members, and a receiver member leaves contact with an intermediate image transfer member as the receiver member moves along a line substantially tangent to the intermediate image transfer member, and wherein the web is held in engagement with each respective intermediate image transfer member in each of the respective nips by a respective support structure which engages the backside of the web under pressure and each respective intermediate image transfer member has a compliant layer of a thickness in the range between 2 mm and 15 mm with a Young's Modulus in the range between 1 MPa and 5 MPa and deforms in each of the respective nips.

44. The reproduction method of claim 43 wherein the endless web is partially wrapped about each intermediate image transfer member so that there is contact of the web with each intermediate image transfer member at a location at least 1 mm from the nip.

45. The reproduction method according to claim 33 wherein at least one of said intermediate image transfer members includes a compliant layer that has a Young's Modulus in the range of between 1 MPa and 5 MPa and said compliant layer of said one intermediate image transfer member is of a thickness in the range of between 2 mm and 15 mm.

46. A reproduction apparatus comprising:

a plural number of primary image forming members for forming respective marking particle images;

a like number of plural intermediate image transfer members each member being associated with a respective different primary image-forming member to receive in transfer a respective marking particle image from an associated primary image forming member;

an endless moving web which forms a transfer nip with each of the plural intermediate image transfer members for supporting a receiver member that moves with the web for serially electrostatically transferring in superposed registration the marking particle images to the receiver member; and wherein each intermediate image transfer member is cylindrical and the endless web is partially wrapped about each intermediate image transfer member.

47. The reproduction apparatus of claim 46 and wherein the web is held in engagement with each respective intermediate image transfer member in each of the respective nips by a respective support structure which engages the backside of the web under pressure and each respective intermediate image transfer member has a compliant layer of a thickness in the range between 2 mm and 15 mm with a Young's Modulus in the range between 0.1 MPa and 10 MPa and deforms in each of the respective nips.

48. The reproduction method of claim 47 wherein there is contact of the web with each intermediate image member at a location at least 1 mm from the nip.

49. A reproduction apparatus comprising:

a primary image forming member;

a moving intermediate image transfer member operatively associated with said primary image forming member;

means for electrostatically transferring a marking particle image formed on said primary image forming member from said primary image forming member to said intermediate image transfer member;

a moving web supported in nip relation with said intermediate image transfer member for supporting a receiver member in a nip between the web and the intermediate image transfer member; and means for establishing an electrical transfer field in said nip for electrostatically transferring a marking particle image to the receiver member brought into intimate contact with said intermediate image transfer member in said nip;

wherein said web is an endless webs the apparatus includes a first support roller and a second support roller, and said endless web is supported by the first and second support rollers so that the web is in nip relation with said intermediate image transfer member, and said means for establishing an electrical transfer field in said nip includes a corona charger in operative association with said intermediate image transfer member between the first and second support rollers; and wherein said second support roller is upstream of said first support roller relative to movement of said web and is connected to an electrical potential source to establish an electrical field to prevent pre-nip ionization.

* * * * *